US007874018B2

(12) United States Patent
Wheater

(10) Patent No.: US 7,874,018 B2
(45) Date of Patent: Jan. 25, 2011

(54) CLOTHING WITH ELASTICALLY EXTENDABLE REGION

(75) Inventor: Walter Wheater, Cheshire (GB)

(73) Assignee: Castlecrafts Limited (GB)

( * ) Notice: Subject to any disclaimer, the term of this patent is extended or adjusted under 35 U.S.C. 154(b) by 458 days.

(21) Appl. No.: 11/914,579

(22) PCT Filed: Jul. 24, 2006

(86) PCT No.: PCT/GB2006/002768

§ 371 (c)(1),
(2), (4) Date: Nov. 16, 2007

(87) PCT Pub. No.: WO2007/096571

PCT Pub. Date: Aug. 30, 2007

(65) Prior Publication Data

US 2008/0201819 A1 Aug. 28, 2008

(30) Foreign Application Priority Data

Feb. 22, 2006 (GB) ..... 0603480.5

(51) Int. Cl.
*A41D 27/00* (2006.01)
*A41D 31/02* (2006.01)

(52) U.S. Cl. ..... 2/69; 2/243.1; 2/115; 2/227

(58) Field of Classification Search ..... 2/69, 2/73, 78.3, 115, 227, 401, 237, 106, 243.1, 2/97, 113, 117, 118, 120, 121, 122, 272, 2/67; 450/122, 123, 124, 8, 19, 20, 74, 75, 450/95, 130, 132

See application file for complete search history.

(56) References Cited

U.S. PATENT DOCUMENTS 2,986,740 A * 6/1961 Schudson ..... 2/115
3,021,845 A * 2/1962 Smith ..... 450/39
3,127,896 A * 4/1964 Puliafico ..... 450/95
3,161,201 A * 12/1964 Welsch ..... 450/124
3,238,945 A * 3/1966 Ambrose et al. ..... 450/124
3,327,707 A 6/1967 Storti
3,338,245 A * 8/1967 Laguzzi ..... 450/123
3,438,376 A * 4/1969 Murdock ..... 450/104
3,489,154 A * 1/1970 Ambrose et al. ..... 450/97
4,135,025 A * 1/1979 Backes ..... 428/195.1
4,720,415 A * 1/1988 Vander Wielen et al. .... 428/152
4,776,916 A * 10/1988 Prunesti et al. ..... 156/291
4,916,755 A * 4/1990 Feigenbaum et al. ..... 2/67
4,956,878 A * 9/1990 Boynton ..... 2/67
5,415,924 A 5/1995 Herlihy, Jr.
5,447,462 A * 9/1995 Smith et al. ..... 450/122

(Continued)

FOREIGN PATENT DOCUMENTS

EP 0233995 A1 9/1987
EP 0734660 A1 10/1996
WO 94/23601 A1 10/1994
WO 02/24015 A1 3/2002
WO 03/077689 A2 9/2003

*Primary Examiner*—Amy B Vanatta
(74) *Attorney, Agent, or Firm*—Adams Intellectual Property Law

(57) ABSTRACT

Elastically deformable sheet (18) is bonded, under heat and pressure to a knitted fabric (16). Both the sheet and the knitted fabric (16) are elastically extendable. The sheet is then heat and pressure bonded to a pair of trousers (12) with the clothing of the trousers being extendable. The fibers of the knit (16) allow the clothing of the trousers to extend with the greater elasticity of the sheet (18) subsequently returning the fibers (16) and the clothing to the original shape.

20 Claims, 1 Drawing Sheet

U.S. PATENT DOCUMENTS 5,804,011 A 9/1998 Dutta et al.
5,855,991 A * 1/1999 McLarty, III ..... 428/195.1
5,916,829 A * 6/1999 Girard et al. ..... 442/244
6,035,448 A * 3/2000 Thomson ..... 2/227
6,205,591 B1 * 3/2001 Wheeler et al. ..... 2/227
6,543,062 B1 * 4/2003 Amsel et al. ..... 2/227

* cited by examiner

CLOTHING WITH ELASTICALLY EXTENDABLE REGION

This is a United States national phase application of International Application PCT/GB2006/002768, filed 24 Jul. 2006, which claims priority to Patent Application No. GB 0603480.5, filed 22 Feb. 2006. The present invention relates to an article of clothing that is elastically extendable at least one region, a method of using such an article of clothing and a method of making such an article of clothing.

TECHNICAL FIELD AND BACKGROUND OF THE INVENTION

It is known to provide trousers that have a degree of stretch. The trousers include warp and weft threads that can elastically expand. During the first wearing of those trousers they fit the wearer very well and hug the figure of the person. However, after repeated washing or after a person has, for instance sat down or stretched the clothing, the shape of the trousers is at least partially lost.

SUMMARY OF THE INVENTION

It is an object of the present invention to attempt to overcome at least one of the above or other disadvantages.

According to one aspect of the present invention, an article of clothing including, at least one region of the clothing, a first part, a second part connected to the first part and a third part connected to the second part, the first, second and third parts at least partially forming the thickness of the clothing at that region, at least one of the second or third parts having a greater elasticity than the other of those parts in at least one direction with the first part being arranged to be extendable in said at least one direction.

The one of the second or third parts of less elasticity may have a degree of elasticity greater than zero. The degree of elasticity may be more than 1 or more than 2 or more than 3 or less than 8 or less than 6 or less than 5 or in the region of 4%.

The region may be elastically stretchable in two directions extending transversely to each other and there may be a different degree of resistance to a stretching force in one direction as compared to another transverse direction.

There may be at least one further region comprising a first part, a second part connected to the first part and a third part connected to the second part, the first, second and third parts at least partially forming the thickness of the clothing at that further region, at least one of the second or third parts having a greater elasticity in at least one direction than the other of those parts in that direction with the first part being arranged to be extendable in that direction. The region and the further region may be spaced from each other and the first part may comprise a part common with the regions. Said one direction of said region may extend in a different direction to said one direction of said further region. The region and the further region may provide different properties and the different properties comprise different elastic resistances. The different properties may comprise different elastic resistance in different directions.

One region may be of greater area than the other region. The first and the second or the third part or any combination thereof of the further region or regions may have any of the features of those parts of said region.

The article may comprise a pair of trousers and the at least one region may be located in the buttock area and/or at crotch area and/or in the waist area.

The article may comprise an upper torso garment and may include at least one region located in the breast area.

The first part may be elastically extendable in at least one direction and the elasticity of the first part may be less than the elasticity of those of the second or third parts having the greater elasticity in at least one direction. The elasticity of the first part may be less than the elasticity of both of the second and third parts.

At least one of the second or third parts is non-extendable in at least one direction. The first part may extend over the complete extent of the clothing and the second and third parts extend over only part of the extent of the clothing.

The third part may include a knit in which the third part may include a weave. The warp or the weft may have a greater degree of resistance to extension than the other of the warp or the weft.

The second part may be connected to the first and/or second part over substantially their complete co-extent.

The second part may comprise a sheet. The sheet may extend at least partially into spaces between fibres of the first or the second part or both.

According to another aspect of the present invention a method of using an article of clothing including a first part connected to a second part and a third part connected to the second part comprises elongating those parts at least one region and subsequently reducing the force that caused the elongation whereby, in at least one direction, the greater elasticity of one of the second or third parts assists in reducing the elongation in that direction.

The method may comprise elongating to the limit one of the second or third parts having less elasticity when elongating the parts.

The method may comprise causing different regions of the clothing to elongate to different extents when subject to the same force.

The method may comprise providing greater resistance to elongation at the buttocks of a pair of trousers than such resistance provided at least one other region.

The method may comprise providing greater resistance to a force exerted in the breast region of a garment than the resistance to the same force at another region of that garment.

The method may comprise when using an article as herein referred to.

According to another aspect of the present invention, a method of making an article of clothing as claimed herein comprise attaching an elastic sheet to extendable fibres on one side and to clothing on the other side.

The method may comprise heating the fibres and sheet in order to assist the attachment therebetween. The method may comprise heating the clothing and sheet in order to assist in the attachment of the clothing and the sheet. The method may comprise heating the sheet and fibres or clothing to assist in attachment. The method may comprise attaching the elastic sheet and extendable fibres at discrete locations on the clothing. The method may comprise attaching elastic sheet and extendable fibres at different locations on the clothing with the elastic and extendable fibres having different extendable qualities.

The present invention is defined in the claims and specification.

BRIEF DESCRIPTION OF THE DRAWINGS

The present invention can be carried into practice in various ways but one embodiment will now be described by way of example and with reference to the accompanying drawings, in which.

DESCRIPTION OF THE PREFERRED EMBODIMENTS AND BEST MODE

Figure 1:
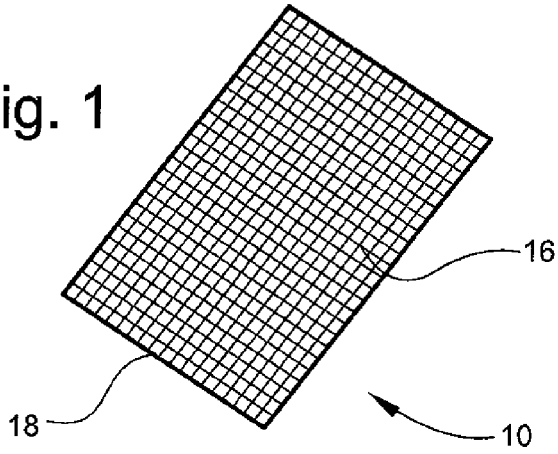
FIG. 1 is a schematic perspective view of a clothing support 10.
Figure 2:
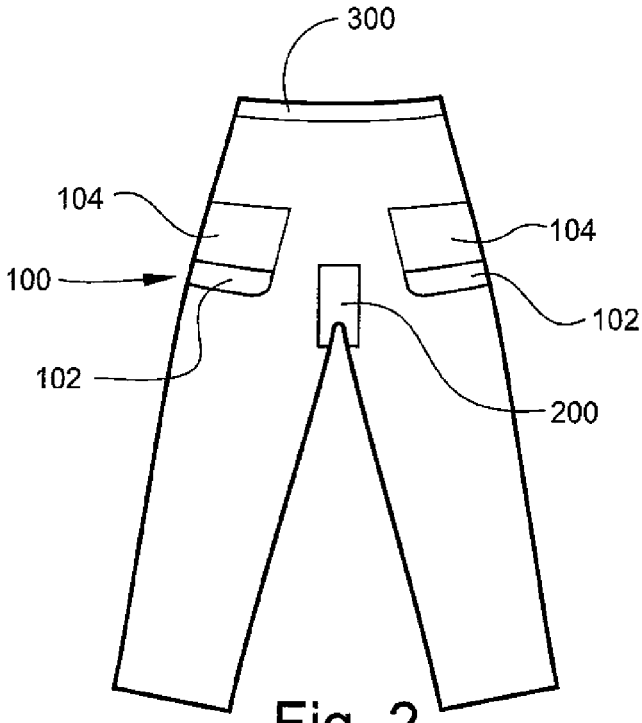
FIG. 2 is a schematic view of half a pair of trousers 12 looking at the rear of the trousers from inside the trousers.

The support 10 comprises a fabric 16 and an elastomeric laminate 18. The knitted fabric 16 and the laminate are fast with each other such that, when one of these stretches so does the other.

The support 10 can be attached to the trousers 12 or the T-shirt 14 by connecting the laminate to the material of that clothing. Such supports 10 are shown by the areas indicated by lines 100, 200, 300 and 400.

When the clothing is worn the fibres in the clothing can stretch. So too can the fibres in the support and so too can the laminate. The supports help maintain the feeling of the support in the areas indicated and also assist in maintaining the shape when being worn and during repeated washing and wearing.

The support and return properties of the support 10 are effected by one of the fibres 16 or the laminate 10 having a greater elastic limit than the other. For instance, if the fibres are able to stretch to a maximum of 5% in one direction and the laminate, if not bonded to any other material, could stretch to 20% in that same direction then the clothing, at that location, can stretch to 5% with the laminate always operating safely within its elastic range to allow the return of the clothing to its natural shape.

It will be appreciated that the fibres in the support 10 could be woven fibres or knitted fibres or any other fibres that permit a degree of elongation and return in at least one direction. In addition, the fibres in the support 10 can be made to have a greater degree of elongation or stretch in one direction than in another direction. Indeed, the fibres may not be able to extend at all in one direction thus limiting the stretch of the support to a purely linear stretch.

Referring now to the trousers 12, the buttock supports 100 allow stretch in all directions in the extent of the clothing. However, the lower part 102 of the support requires to resist sagging of the buttock more than the upper part 104. Consequently the fibres 16 in the part 102 have very restricted elastic movement, if any at all, in the X-direction as compared to the corresponding fibres in the Y-direction. For instance there may be 1% maximum expansion in the part 102 in the X-direction but 4% maximum in the part 104 in that direction. The fibres of the parts 102 and 104 may have the same elastic stretch properties in the Y-direction such as a maximum of 5%. The fibres of the parts 102 and 104 may be attached to a common laminate. Alternatively, the parts 102 and 104 may be made as separate supports.

The support 200 is for the crotch area. This extends up the rear of the trousers and, to a greater extent, up the front of the trousers to hold the clothing taut and when stretched in that region, without discomfort. Consequently the maximum stretch may be 6% in the X and Y-directions.

The support 300 is for a waistband. Consequently it is not necessary to have any stretch in the Y-direction (although such stretch could be included and would be redundant). In the X-direction expansion of a maximum of 5% may be possible.

Figure 3:
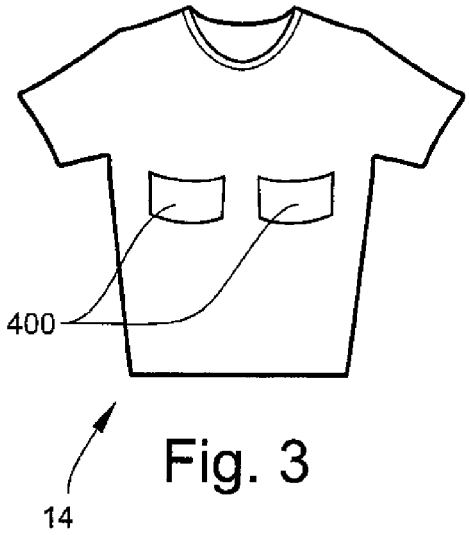
FIG. 3 is a schematic view of half a T-shirt 14 looking at the front of the T-shirt from the inside.

In FIG. 3, the supports 400 are arranged to lift and support the breasts of a wearer. The supports are arcuate and they hold the fabric of the T-shirt to prevent any significant elastic extent in the X-direction such as to restrict that expansion from 0 to 3%, for instance. In this way the breasts are supported and prevented from sagging down to any significant extent. Thus the T-shirt can be worn without a bra and will retain its shape by returning to its shape at the location of the supports 400.

Although not shown, the supports could be applied to knickers that are designed to hold the tummy of a wearer in. Indeed the supports could be applied to any article of clothing and may be of use in socks or boots or any other garment.

The clothing, when the support is not present, may be made to elastically stretch or just to stretch without, by itself, being able to return to its original configuration.

In each of the examples, it can be seen that the supports are located on the inside of the clothing. Thus in non-transparent clothing the supports are, in use, invisible.

Whilst the fibre in the support has been described as being the limiting factor in any expansion of the clothing in that region it is possible for the laminate to have a lesser degree of expansion whereby the fibres are always operating well within their elastic range such that the fibres 16 can pull the laminate back.

It will also be appreciated that the fibres or the laminate do not have to reach their limit of elastic stretch in order for the clothing to operate in an extremely satisfactory manner.

Whilst the supports 100, 200, 300 and 400 can be made in various ways, one embodiment of forming the supports and one embodiment of securing the supports and clothing will now be described.

A knitted fabric 16 having a 4% stretch in both the warp and weft direction is bonded to a 1 micron thick laminate sheet. The fibres in the fabric may be close tricot knitted fabric. Both the fibres and the laminate are thermoplastic polyurethane or a thermoplastic polyester with elastomeric properties.

The fabric and laminate are then passed through opposed rollers at a rate of 2 m every 12 seconds and under a pressure of 4 bar. In addition, heat of 160° C. is applied at the roller nip. This is sufficient to soften the laminate and to impress the fabric at least partially into the facing surface of the laminate and produces a support approximately 1 mm thick.

After forming the support 10 it is then cut to size (100, 200, 300, 400, for instance). Then, with the laminate side of the support (as opposed to the fabric side) against the material of the clothing, the clothing and support are passed through the same rollers under the same conditions to soften the laminate and impress the laminate at least partially into the material of the clothing to effect a strong bond between the support and the clothing.

The impression of the fabrics and laminate may be such that the laminate at least partially surrounds and may at least partially surround more than 50% of the periphery of at least some of the fibres in the fabrics.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An article of clothing including, at least one region of the clothing, a first part comprising clothing, a second part comprising an elastic sheet connected to the first part on the inside of the clothing and a third part comprising fibres connected to the sheet, the sheet and third part extending over only part of the extent of the first part, the first, second and third parts at least partially forming the thickness of the clothing at that region, the second part having a greater elasticity than the third part in at least one direction with the clothing being arranged to be extendable in said at least one direction.

2. An article as claimed in claim 1 in which the one of the second or third part of less elasticity has a degree of elasticity greater than zero.

3. An article as claimed in claim 2 in which said degree of elasticity is more than 1%.

4. An article as claimed in claim 1 in which the region is elastically stretchable in two directions extending transversely to each other.

5. An article as claimed in claim 4 in which the region is elastically stretchable in two directions with there being a different degree of resistance to a stretching force in one direction as compared to another transverse direction.

6. An article as claimed in claim 1 including at least one further region comprising a first part, a second part connected to the first part and a third part connected to the second part, the first, second and third parts at least partially forming the thickness of the clothing at that further region, at least one of the second or third parts having a greater elasticity in at least one direction than the other of those parts in that direction with the first part being arranged to be extendable in that direction.

7. An article as claimed in claim 6 in which the region and the further region are spaced from each other.

8. An article as claimed in claim 7 in which the first part comprises a part common with the regions.

9. An article as claimed in claim 6 in which said one direction of said region extends in a different direction to said one direction of said further region.

10. An article as claimed in claim 6 in which the region and the further region provide different properties.

11. An article as claimed in claim 10 in which the different properties comprise different elastic resistance in different directions.

12. An article as claimed in claim 6 in which one region is of greater area than the other region.

13. A method of using an article of clothing comprising providing at least one region of the clothing, a first part comprising clothing, a second part comprising an elastic sheet connected to the first part on the inside of the clothing and a third part comprising fibres connected to the sheet, the sheet and third part extending over only part of the extent of the first part, the first, second and third parts at least partially forming the thickness of the clothing at that region, the second part having a greater elasticity than the third part in at least one direction with the clothing being arranged to be extendable in said at least one direction, comprising elongating said parts at said region and subsequently reducing the force that caused the elongation whereby, in said at least one direction, the greater elasticity of the second part assists in reducing the elongation in said direction.

14. A method as claimed in claim 13 comprising elongating the third part to an elastic limit of the third part when elongating the parts.

15. A method as claimed in claim 13 comprising causing different regions of the clothing to elongate to different extents when subject to the same force.

16. A method as claimed in claim 13 comprising providing greater resistance to elongation at the buttocks of a pair of trousers than such resistance provided at least one other region.

17. A method of making an article of clothing including, at least one region of the clothing, a first part comprising clothing, a second part comprising an elastic sheet connected to the first part on the inside of the clothing and a third part comprising fibres connected to the sheet, the sheet and third part extending over only part of the extent of the first part, the first, second and third parts at least partially forming the thickness of the clothing at that region, the second part having a greater elasticity than the third part other of those in at least one direction with the fibrous clothing being arranged to be extendable in said at least one direction, the method comprising:

attaching the elastic sheet to the fibres on one side and to the clothing on the other side.

18. A method as claimed in claim 17 comprising heating the fibres and sheet in order to assist the attachment therebetween.

19. A method as claimed in claim 17 comprising heating the clothing and sheet in order to assist in the attachment of the clothing and the sheet.

20. A method as claimed in claim 17 comprising attaching an elastic sheet and extendable fibres at different locations on the clothing with the elastic and extendable fibres having different extendable qualities.

* * * * *

UNITED STATES PATENT AND TRADEMARK OFFICE

CERTIFICATE OF CORRECTION

PATENT NO. : 7,874,018 B2
APPLICATION NO. : 11/914579
DATED : January 25, 2011
INVENTOR(S) : Walter Wheater It is certified that error appears in the above-identified patent and that said Letters Patent is hereby corrected as shown below:

Col. 5, claim 2:

Lines 1 and 2, delete "~~one of the second or~~"

Col. 6, claim 17:

Line 9, delete "~~other of those~~"
Line 10, delete "~~fibrous~~"

Signed and Sealed this
Fourteenth Day of June, 2011

David J. Kappos

David J. Kappos
*Director of the United States Patent and Trademark Office*